US005498076A

United States Patent [19]

Krzywdziak

[11] Patent Number: 5,498,076

[45] Date of Patent: Mar. 12, 1996

[54] STIRRER LID FOR A PAINT STIRRING MACHINE

[75] Inventor: Alain Krzywdziak, Orleans, France

[73] Assignee: F.A.S., Orleans Cedex, France

[21] Appl. No.: 267,480

[22] Filed: Jun. 28, 1994

[30] Foreign Application Priority Data

Jul. 5, 1993 [FR] France ..... 93 08194

[51] Int. Cl.[6] ..... B01F 7/16

[52] U.S. Cl. ..... 366/245; 277/89; 277/93 R; 277/212 FB; 366/605

[58] Field of Search ..... 366/247, 244, 366/245, 246, 247, 248, 249, 250, 251, 242, 605; 277/212 FB, 89, 93 R, 93 SD

[56] References Cited

U.S. PATENT DOCUMENTS

| | | | |
|---|---|---|---|
| 2,802,649 | 8/1957 | Stockton | 366/605 |
| 3,162,338 | 12/1964 | Grubelic | 366/605 |
| 3,175,808 | 3/1965 | Dedoes | 366/247 |
| 4,184,778 | 1/1980 | Terrels | 366/250 |
| 4,380,399 | 4/1983 | Godat | 366/605 |
| 4,501,500 | 2/1985 | Terrels | 366/250 |
| 4,648,605 | 3/1987 | Marsi | 277/89 |

*Primary Examiner*—Robert W. Jenkins
*Attorney, Agent, or Firm*—Scully, Scott, Murphy & Presser

[57] ABSTRACT

The invention relates to a lid for a paint stirring machine.

This lid is provided with a conventional sealing gaiter (13) on the stirrer rod (5) bearing on the hub (15) of the lid via its circular upper collar (19). It includes a bearing washer (3) for the stirrer rod, this washer being interposed between the said hub (15) and the said collar (19) of the gaiter, this washer being shaped with a surface for receiving the collar which complements the latter and an opposing surface for being applied to the hub of the lid, and being provided with at least three snugs (21) on the said surface for receiving the collar, these snugs being arranged around the periphery of this collar, applied to it, evenly angularly arranged so that the periphery cannot move laterally with respect to this hub, these snug (21) each being equipped with a catch shaped to have the said collar (19) clipped into it.

7 Claims, 1 Drawing Sheet

STIRRER LID FOR A PAINT STIRRING MACHINE

Figure 1:
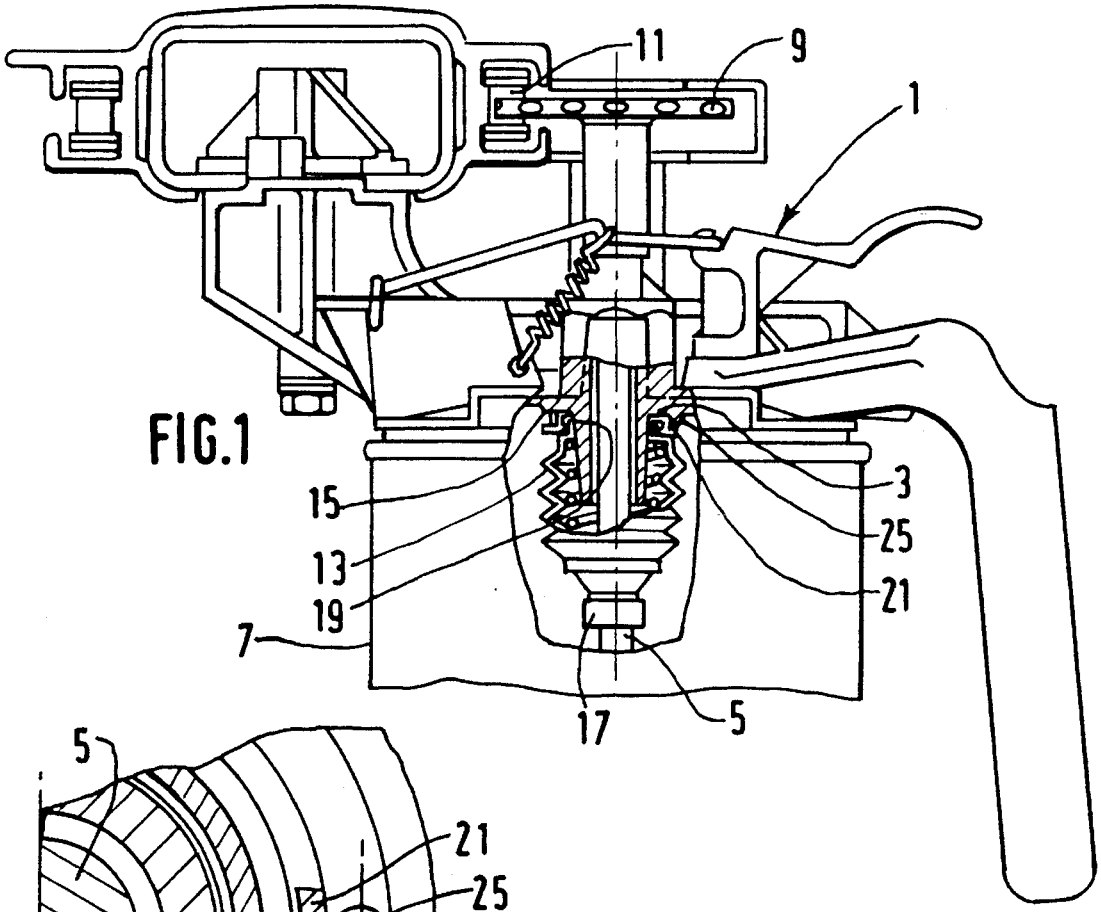

The invention relates to a stirrer lid for a paint machine.

Stirrer lids for tins of color mounted hanging from paint stirring machines are known. These lids each include a central stirrer rod driven in terms of rotation by the machine on which they are mounted. The rod is mounted on the lid so that it passes through it, and sealing of this mounting is ensured by a gaiter surrounding the rod at its upper part and applied under pressure to the lid. However, the gaiter set into rotation with the rod and bearing directly via its upper end collar on the lid hub, by means of the friction generated may lead, on the one hand, to wear on the hub and, on the other hand, to metal particles becoming detached and affecting the paint.

The invention aims to overcome this drawback by proposing a stirrer lid, of the type provided with a conventional sealing gaiter on the stirrer rod bearing on the hub of the lid via its circular upper collar, characterized in that it includes a bearing washer for the stirrer rod, this washer being interposed between the said hub and the said collar of the gaiter, this washer being shaped with a surface for receiving the collar which complements the latter and an opposing surface for being applied to the hub of the lid, and being provided with at least three snugs on the said surface for receiving the collar, these snugs being arranged around the periphery of this collar, applied to it, evenly angularly arranged so that the periphery cannot move laterally with respect to this hub, these snugs each being equipped with a catch shaped to have the said collar clipped into it, the washer remaining free in terms of rotation, held laterally on the collar via the said catches, and in that the washer is applied to the hub of the lid under the elastic return of the gaiter being locked in terms of rotation to the hub by a suitable immobilizing means formed on the lid.

This arrangement results, on the one hand, in an easy mounting of the washer thus equipped on the sealing gaiter of the stirrer assembly, owing to the clipping effect of the said snugs and, on the other hand, because it is locked in terms of rotation to the hub of the lid, to a total absence of wear on the lid hub and consequently of emission of worn particles of the material of the lid affecting the paint and particularly pale colors. Sealing is perfectly ensured both on the surface of application of the washer, applied under pressure to the hub and on those surfaces of the washer and of the collar of the gaiter which can move relative to one another in terms of rotation, by virtue of the application of the gaiter so that it is returned toward the lid.

The washer advantageously includes two circular opposing flat faces, being shaped with dimensions equivalent to those of the gaiter collar which is conventionally flat and circular.

This washer is made of plastic, for example of polyethylene, of which the coefficient of friction with the gaiter collar, also made of synthetic material, is low. Wear on the moving facing surfaces is minimal.

The snugs used for clipping may be formed on the outside of the collar of the gaiter or on the inside. In the latter case, possible worn particles owing to the rotation over the clipping catches of the snugs are contained within the gaiter.

These snugs are advantageously four in number, distributed in a circle at ninety degrees from one another on an axis of diameter either slightly greater than that of the collar or slightly less than it, to within the clearance.

The said means for immobilizing the washer on the hub advantageously consists of a peg formed on or fixed to the lid in the region of the snugs of the washer. This peg abuts against one of the snugs, thus locking the washer on the hub in terms of rotation.

Figure 3:
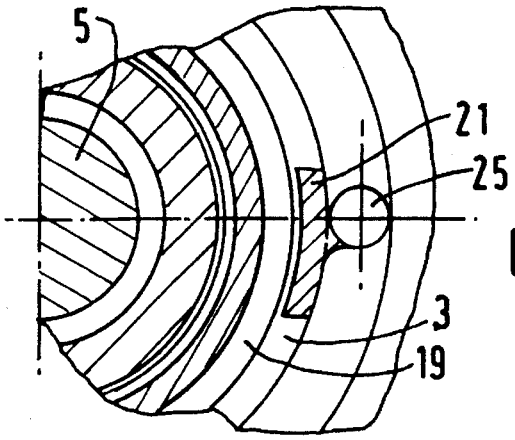
Figure 2:
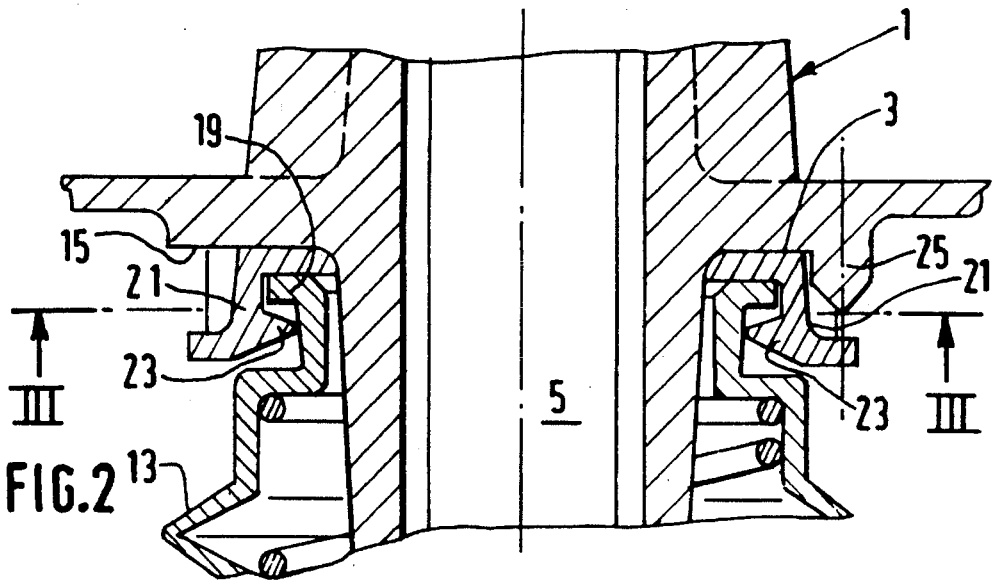

The invention is described hereafter with reference to one embodiment and with the aid of the appended drawings, in which:

FIG. 1 is a view in partial section of a stirrer lid for tins of color according to the invention, FIG. 2 is an enlarged view in section showing the washer for bearing on the lid, and FIG. 3 is a partial enlarged view in section along the line III—III of FIG. 2.

As represented in FIGS. 1 and 2, the lid 1 equipped with a bearing washer 3 according to the invention is of the type including a stirrer rod 5 mounted so that it can rotate on the lid and passing through it perpendicularly through its central part. A tin of paint 7 is fixed to the lid via its lower peripheral edge. The lid is mounted suspended via projecting lateral lugs on the machine in a conventional manner, and the stirrer rod is driven in terms of rotation by means of its upper sprocket 9 in engagement with a chain 11 moved over the length of the machine.

This rod includes a sealing gaiter 13 surrounding its upper part and bearing on the hub of the lid 15. The gaiter is fixed to the stirrer rod via its lower end part 17 and rotates with it. At its upper end it includes a flat annular collar 19. The washer 3 is a flat annular washer of inside diameter equivalent to that of the collar 19 and of slightly greater outside diameter. This washer is interposed between the lower central part or hub of the lid and the said collar. It is applied under pressure to the corresponding flat surface of the hub, under the upward elastic return of the gaiter. It is of small thickness (approximately 0.5 mm), made of polyethylene, as is the gaiter. It includes four lateral snugs 21 on its periphery, arranged at 90° from one another and projecting downward. These snugs surround the collar of the gaiter with a small amount of clearance. They are equipped with a lower catch 23 pointing toward the inside at its end and tapered, capable of allowing the washer to be clipped onto the collar of the gaiter when the stirrer rod, equipped with its gaiter, is mounted on the body of the lid.

This operation is effected manually, in an easy manner, engagement being facilitated by the internal tapering of the catches which promotes reception of the collar. Once the washer has been fixed to the collar by its four snugs, there only remains to fit the rod to the body of the lid, the gaiter being applied, together with its bearing washer, to the central hub of the lid.

The latter includes (FIG. 3) a tapered peg 25 forming a projection at the periphery of the applied washer. This peg comes into contact with one of the snugs 21 of the washer, locking it to the hub 15 in terms of rotation. The taper of the peg also promotes the reception and positioning of the washer on the hub, preventing interference of components.

When the assembly is mounted and the stirrer lid is in use, the collar of the gaiter rotates on the washer and the wear of the hub of the body of the lid which was known in the state of the art is thus completely prevented.

Naturally, numerous embodiment variants are encompassed within the scope of the invention. The shape of the washer may vary, as may that of the snugs, their number, their location on the outside or on the inside of the washer in relation to the collar, or even on the lower surface for receiving the collar, as may the element for locking the washer to the hub which may be obtained in various other ways, for example by means of a peg on the hub in a groove or hole in the washer, or conversely a peg on the washer in a hole in the lid.

What is claimed is:

1. Stirrer lid for mounting on a tin containing a stirrable fluid substance, said lid including a hub; a stirrer rod having an upper collar bearing on the hub of said lid; a bellows-shaped sealing gaiter extending about said stirrer rod; a bearing washer for the stirrer rod, said washer being positioned between said lid hub and said collar, said washer having a surface for receiving a complementary surface of the collar; and an opposite surface for contacting the lid hub, at least three latching snugs on said surface for receiving the collar, said latching snugs being spaced about the periphery of said collar, uniformly angularly arranged such that the periphery of said collar is inhibited from moving laterally relative to said lid hub, each of said snugs including a catch for latchingly engaging said collar, said washer being rotatable while maintained laterally engaged on the collar through said catches, and said washer engages the lid hub responsive to a biasing force exerted upon the gaiter rotation of the hub relative to immobilizing means formed on the lid.

2. Stirrer lid according to claim 1, wherein said washer includes two circular opposing flat faces which are dimensional equivalent to surfaces on the gaiter collar which are each flat and circular.

3. Stirrer lid according to claim 1 or 2, wherein said washer is of a plastic material, said gaiter collar being formed of a plastic material whereby the coefficient of friction between the gaiter collar and washer is low.

4. Stirrer lid according to claim 1, wherein the latching snugs are formed on the outside of the collar.

5. Stirrer lid according to claim 1, wherein the latching snugs are formed on the inside of the collar.

6. Stirrer lid according to claim 1, wherein there are provided four of said latching snugs located about a circle at ninety degrees spacing from each other, said circle having a diameter either greater or smaller than that of the collar within a specified clearance.

7. Stirrer lid according to claim 1, wherein said means for immobilizing the washer on the lid hub comprises peg means on the lid proximate the snugs of the washer.

* * * * *